US008590936B2

(12) United States Patent
Payson

(10) Patent No.: US 8,590,936 B2
(45) Date of Patent: Nov. 26, 2013

(54) SNOWBOARD STOP OR STABILIZATION APPARATUSES AND METHODS

(76) Inventor: Jeffrey Keith Payson, Frisco, TX (US)

( * ) Notice: Subject to any disclaimer, the term of this patent is extended or adjusted under 35 U.S.C. 154(b) by 64 days.

(21) Appl. No.: 13/372,504

(22) Filed: Feb. 14, 2012

(65) Prior Publication Data

US 2013/0207372 A1 Aug. 15, 2013

(51) Int. Cl.
*A63C 7/00* (2006.01)

(52) U.S. Cl.
USPC ..... 280/809; 280/605

(58) Field of Classification Search
USPC ..... 280/604, 605, 809, 811, 816, 825
See application file for complete search history.

(56) References Cited

U.S. PATENT DOCUMENTS

| | | | | |
|---|---|---|---|---|
| 2,187,629 | A * | 1/1940 | Rhoades et al. | 280/825 |
| 4,002,349 | A * | 1/1977 | Dopp | 280/814 |
| 4,544,179 | A * | 10/1985 | Boudreau | 280/604 |
| 5,012,597 | A * | 5/1991 | Thomasson | 36/59 C |
| 5,649,722 | A | 7/1997 | Champlin | |
| 5,836,091 | A * | 11/1998 | Cook | 36/59 R |
| 6,012,739 | A * | 1/2000 | Weiss et al. | 280/814 |
| 6,264,215 | B1 * | 7/2001 | Carlson et al. | 280/14.21 |
| 6,450,512 | B1 | 9/2002 | Carr | |
| 6,604,755 | B2 | 8/2003 | Ayliffe et al. | |
| 7,287,775 | B2 * | 10/2007 | Walker et al. | 280/604 |
| 7,837,232 | B2 | 11/2010 | Richards | |
| 2006/0267332 | A1 | 11/2006 | Fischli | |
| 2007/0096432 | A1 | 5/2007 | Wilson | |
| 2007/0246913 | A1 * | 10/2007 | Coulbourn | 280/604 |
| 2008/0023956 | A1 | 1/2008 | Fischli | |

FOREIGN PATENT DOCUMENTS

| | | | |
|---|---|---|---|
| JP | 2003102895 | A | 4/2003 |
| JP | 2008253414 | A | 10/2008 |
| WO | WO/96/26774 | | 9/1996 |

* cited by examiner

*Primary Examiner* — Frank Vanaman
(74) *Attorney, Agent, or Firm* — Afghani Law Firm; Kevin Afghani

(57) ABSTRACT

In one embodiment, a snowboard stop device includes a bottom portion having a snowboard-contactable side and a ground-contactable side. The ground-contactable side of the bottom portion has one or more protrusions. The snowboard stop device includes a top portion having a snowboard-contactable side, and a curved edge portion joining the bottom portion of the snowboard stop device to the top portion of the snowboard stop device. The snowboard stop device is clippable on an edge of a snowboard such that the snowboard-contactable side of the bottom portion at least partially contacts a bottom side of the snowboard and the snowboard-contactable side of the top portion at least partially contacts a top side of the snowboard. Friction is caused between the ground and the one or more protrusions on the ground-contactable side of the bottom portion such that the snowboard at least partially stops relative to the ground.

20 Claims, 7 Drawing Sheets

SNOWBOARD STOP OR STABILIZATION APPARATUSES AND METHODS

TECHNICAL FIELD

The illustrative embodiments relate generally to snowboard-related devices, and more particularly, to snowboard stop or stabilization apparatuses and methods.

BACKGROUND

Snowboarding is a sport that may involve descending a slope that is covered with snow or ice on a snowboard attached to a snowboarder's feet using a special boot set onto a mounted binding. While the sport of snowboarding generally involves movement of the snowboard across a slippery surface, there are times when a snowboarder may need to be at rest or stabilized at a stopping point, including, but not limited to, when the snowboarder needs to insert his or her boots into the snowboard bindings or when the snowboarder needs to remove his or her boots from the snowboard bindings. Indeed, a snowboarder may sometimes need to stop or be stabilized on a sloped area. Current snowboards, being primarily adapted to slide along snowy surfaces, fail to effectively or conveniently stop or stabilize a snowboarder.

SUMMARY

According to an illustrative embodiment, a snowboard stop device includes a bottom portion having a snowboard-contactable side and a ground-contactable side. The ground-contactable side of the bottom portion has one or more protrusions. The snowboard stop device includes a top portion having a snowboard-contactable side, and a curved edge portion joining the bottom portion of the snowboard stop device to the top portion of the snowboard stop device. The snowboard stop device is clippable on an edge of a snowboard such that the snowboard-contactable side of the bottom portion at least partially contacts a bottom side of the snowboard and the snowboard-contactable side of the top portion at least partially contacts a top side of the snowboard. When the snowboard stop device is clipped to the snowboard, friction is caused between the ground and the one or more protrusions on the ground-contactable side of the bottom portion such that the snowboard at least partially stops relative to the ground.

According to another illustrative embodiment, an apparatus for stopping a snowboard includes a first snowboard stop device. The first snowboard stop device includes a bottom portion having a snowboard-contactable side and a ground-contactable side. The ground-contactable side of the bottom portion has one or more protrusions. The first snowboard stop device includes a top portion having a snowboard-contactable side, and a curved edge portion joining the bottom portion of the first snowboard stop device to the top portion of the first snowboard stop device. The first snowboard stop device is clippable adjacent a longitudinal edge of a snowboard such that the snowboard-contactable side of the bottom portion at least partially contacts a bottom side of the snowboard and the snowboard-contactable side of the top portion at least partially contacts a top side of the snowboard. The top and bottom portions of the first snowboard stop device press against the top and bottom sides of the snowboard to cause the first snowboard stop device to be substantially anchored adjacent the longitudinal edge of the snowboard at which the first snowboard stop device is clipped. When the first snowboard stop device is clipped to the snowboard and the ground-contactable side of the bottom portion contacts the ground, the snowboard at least partially stops relative to the ground due to friction between the ground and the one or more protrusions on the ground-contactable side of the bottom portion.

According to another illustrative embodiment, a method of using a snowboard stop device includes providing a snowboard stop device. The snowboard stop device includes a bottom portion having a snowboard-contactable side and a ground-contactable side. The ground-contactable side of the bottom portion has one or more protrusions. The snowboard stop device also includes a top portion having a snowboard-contactable side, and a curved edge portion joining the bottom portion of the snowboard stop device to the top portion of the snowboard stop device. The method also includes clipping the snowboard stop device at an edge of a snowboard such that the snowboard-contactable side of the bottom portion at least partially contacts a bottom side of the snowboard and the snowboard-contactable side of the top portion at least partially contacts a top side of the snowboard. When the snowboard stop device is clipped to the snowboard and the ground-contactable side of the bottom portion contacts the ground, friction is caused between the ground and the one or more protrusions on the ground-contactable side of the bottom portion such that the snowboard at least partially stops relative to the ground.

DETAILED DESCRIPTION

Figure 1:
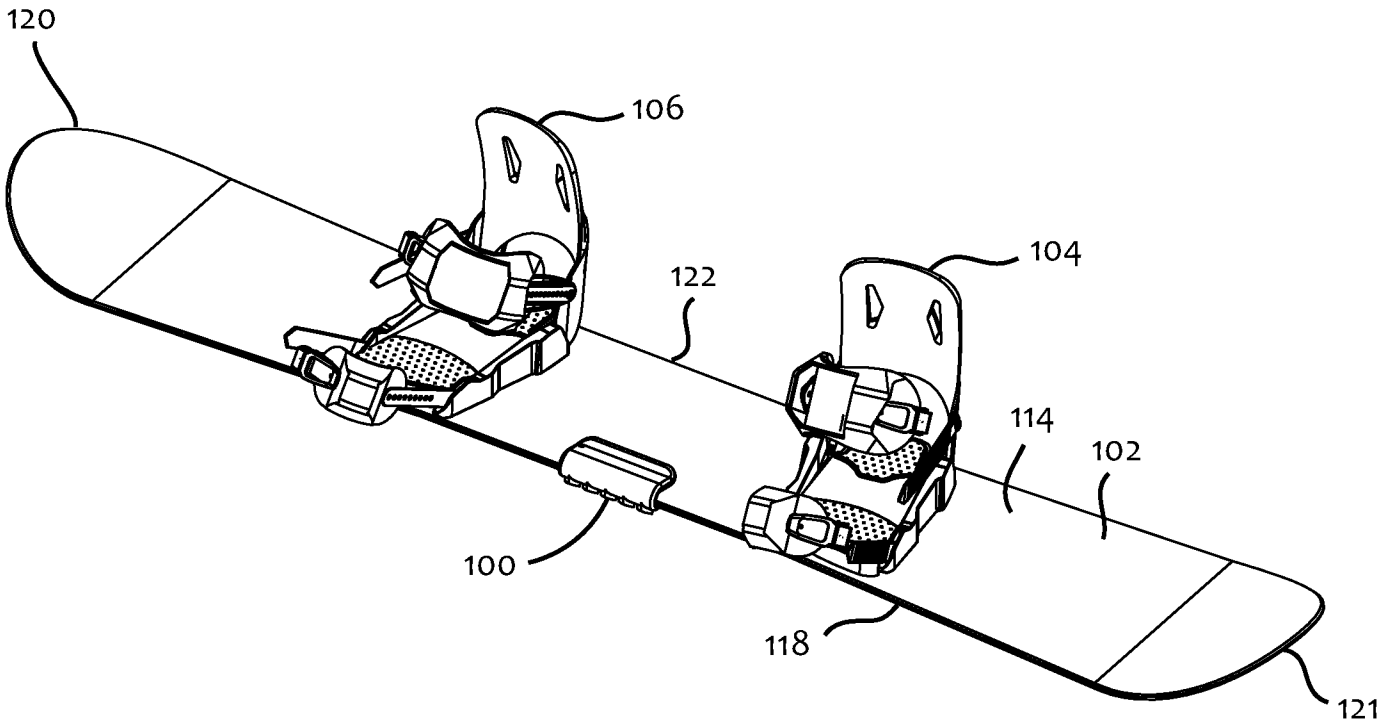
FIG. 1 is a schematic, perspective view of a snowboard on which a snowboard stop device is mounted according to an illustrative embodiment.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Referring to FIGS. 1 through 7, an illustrative embodiment of a snowboard stop device 100 mounted on the edge of a snowboard 102 is shown. The snowboard stop device 100 may be clipped onto the edge of the snowboard 102 to stop or stabilize the snowboard 102 relative to the ground, which may be covered in snow (e.g., packed snow, powdered snow, etc.), ice (e.g., smooth ice, abrasive ice, etc.), or other slippery material. Unless otherwise indicated, as used herein, "or" does not require mutual exclusivity. Once the snowboard 102 has been stabilized or stopped using the snowboard stop device 100, the snowboarder may insert or remove his or her snowboard boots into the left and right bindings 104 and 106, or may simply remain stopped or stabilized for any other reason. When the snowboarder no longer desires to remain stopped or stabilized, the snowboarder may remove, or unclip, the snowboard stop device 100 from the edge of the snowboard 102, thus allowing the snowboarder to once again freely slide along the ground. In the illustrative embodiments, the terms "stop" or "stopping" encompass braking, slowing down, partially stopping, or stabilizing.

Due to the slippery nature of snow and ice, it can be difficult for snowboarders to insert or remove their feet into or out of the bindings 104 and 106 of the snowboard 102 while standing because the snowboard 102 easily slides on such a slippery surface. It can also be difficult to remain stationary while on snow or ice, particularly when located on a sloped area. The snowboard stop device 100, when clipped onto the snowboard 102, helps to, inter alia, prevent snowboarders from sliding or failing while remaining stationary or securing their feet relative to the bindings 104 and 106, including when located on a sloped area. Specifically, the snowboard stop device 100, when clipped onto the snowboard 102, may restrain or prevent the snowboard 102 from sliding relative to the snow or ice, thereby acting as a stability or braking device. When the snowboarder is finished using the snowboard stability device 100 to remain stable, the snowboarder may pull, or unclip, the snowboard stop device 100 off of the snowboard 102. The snowboard stop device 100 may be conveniently sized to allow the snowboarder to store the snowboard stop device 100 into his or her pant pocket, jacket pocket, bag pocket, etc. while not in use.

The snowboard stop device 100 includes a top portion 108, a bottom portion 110, and a curved edge portion 112 that joins, couples, connects, or otherwise associates the bottom portion 110 to the top portion 108. When clipped to the snowboard 102, the top portion 108 of the snowboard stop device 100 may press, or be biased, against a top side 114 of the snowboard 102 while the bottom portion 110 of the snowboard stop device 100 presses, or is biased, against a bottom side 116 of the snowboard 102 such that the snowboard stop device 100 is substantially anchored at or adjacent the edge of the snowboard 102 at which the snowboard stop device 100 is clipped. In this manner, the top and bottom portions 108, 110 of the snowboard stop device 100 may "squeeze" the snowboard 102 to help ensure that the snowboard stop device 100 does not easily fall off the snowboard 102 while in use, while still allowing the snowboarder to conveniently pull the snowboard stop device 100 off of the snowboard 102 when desired.

Figure 2:
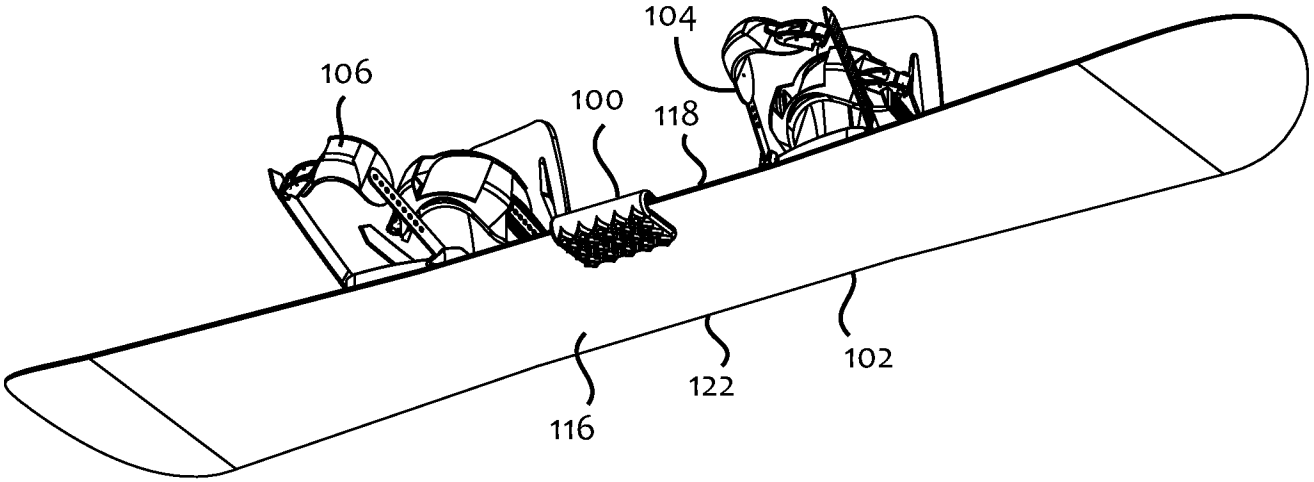
FIG. 2 is a schematic, perspective view of the bottom side of the snowboard in FIG. 1 on which the snowboard stop device is mounted.
Figure 3:
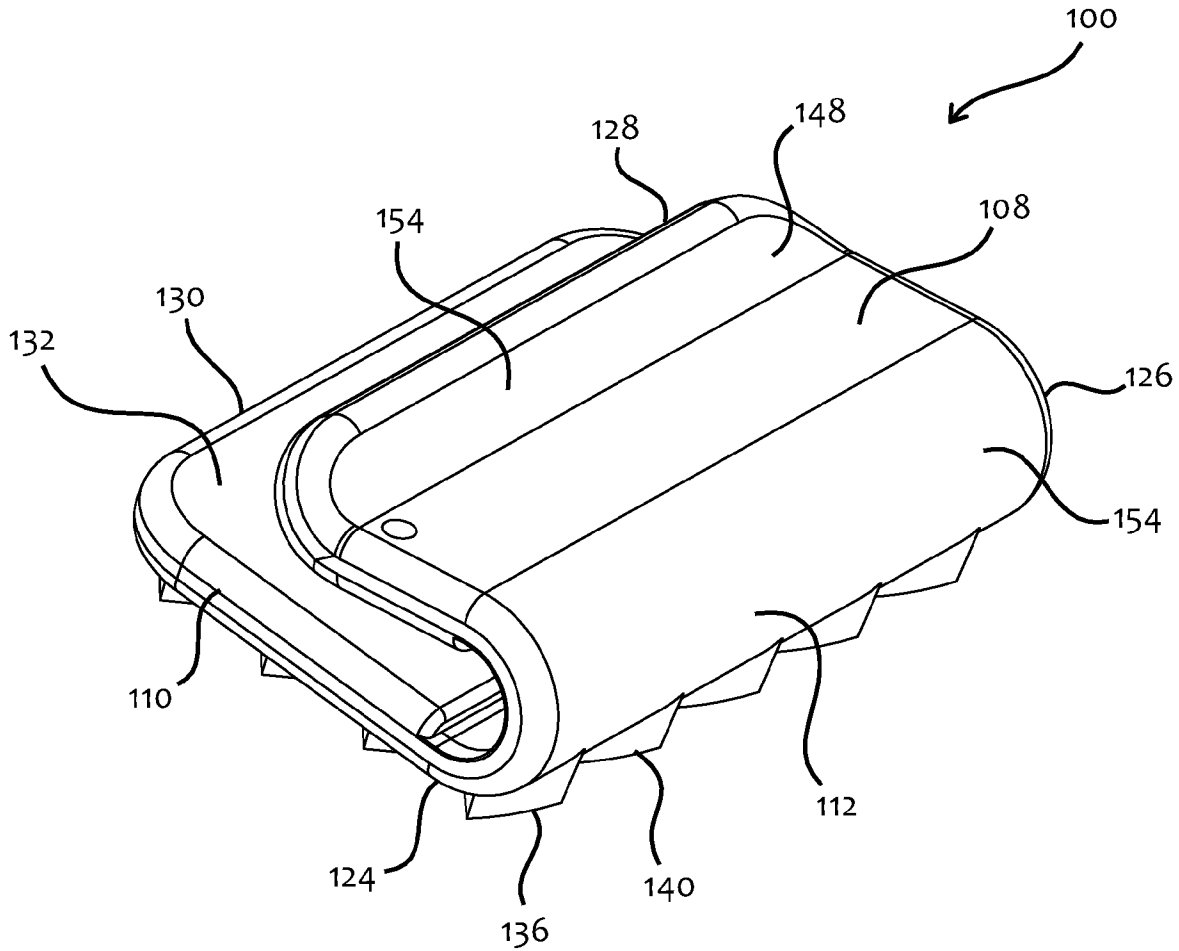
FIG. 3 is a schematic, perspective view of the top portion of a snowboard stop device according to an illustrative embodiment.
Figure 4:
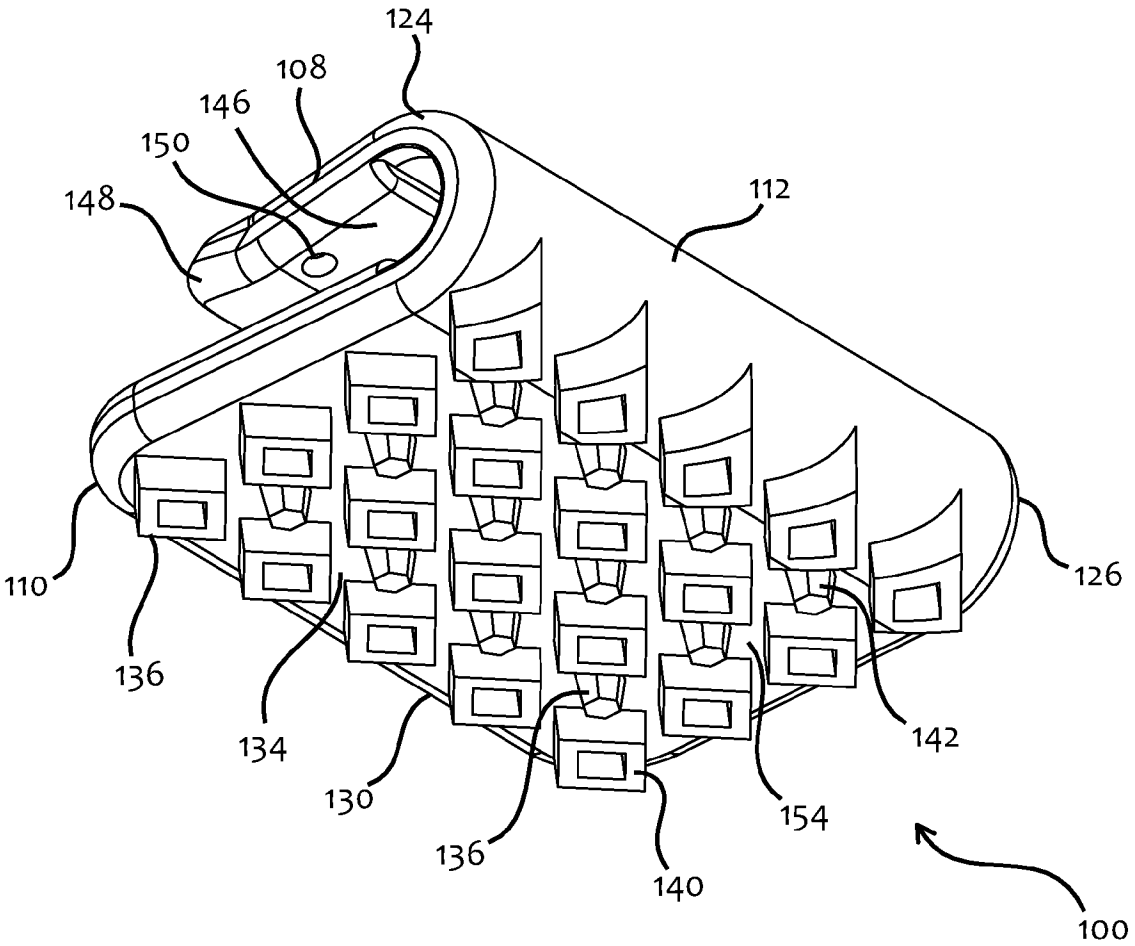
FIG. 4 is a schematic, perspective view of the bottom portion of the snowboard stop device in FIG. 3.
Figure 5:
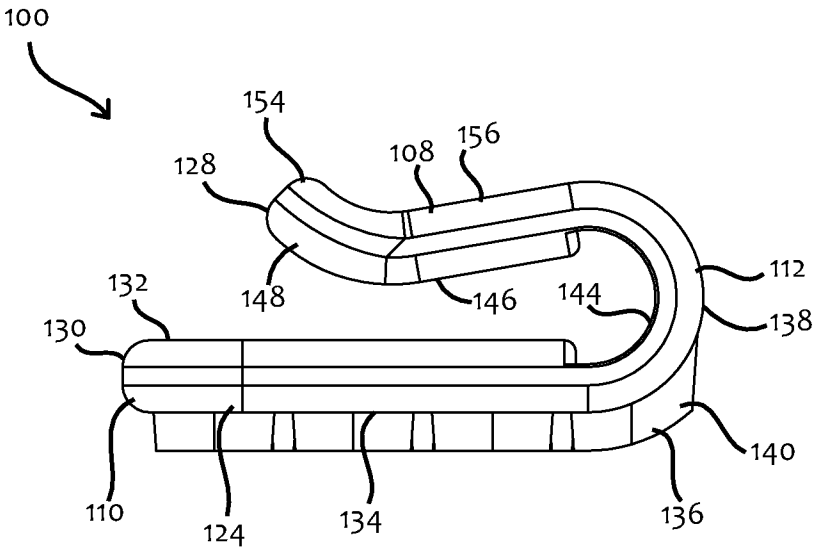
FIG. 5 is a schematic, side view of the snowboard stop device in FIG. 3.
Figure 6:
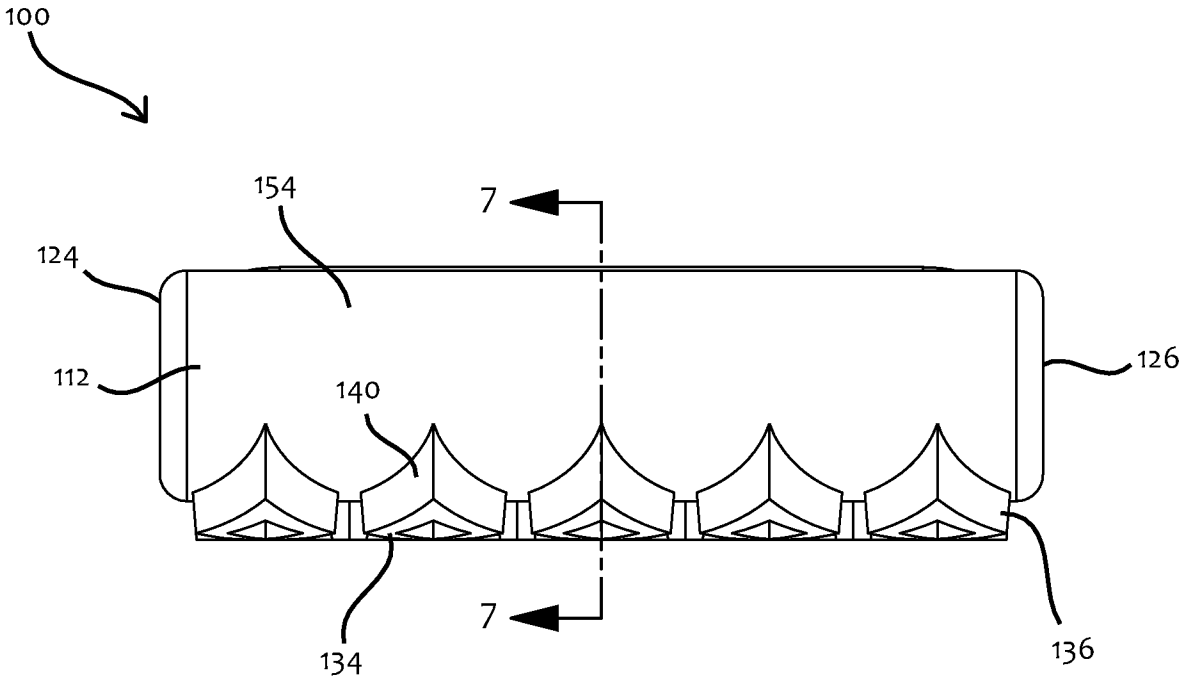
FIG. 6 is a schematic, front view of the snowboard stop device in FIG. 3.

As shown in FIGS. 1 and 2, the snowboard stop device 100 may be clipped onto a toe-side longitudinal edge 118 of the snowboard 102. More specifically, the snowboard stop device 100 is shown to be clipped at a portion of the toe-side longitudinal edge 118 that is between the left and right bindings 104, 106. However, it will be appreciated that the snowboard stop device 100 may be clipped at any point of any edge of the snowboard 102, depending upon the embodiment. For example, the snowboard stop device 100 may be clipped onto one of the end edges 120, 121 or the heel-side longitudinal edge 122 of the snowboard 102. It will also be appreciated that any number of snowboard stop devices (e.g., 2, 3, etc.) may be clipped onto any edge of the snowboard 102; in this embodiment, the two or more snowboard stop devices that are clipped to the snowboard 102 may be similar, identical, or analogous in structure, and each of the two or more snowboard stop devices may be clipped to the same or different edges of the snowboard 102.

The snowboard stop device 100 has a first side edge 124 and a second side edge 126 extending along the top portion 108, the curved edge portion 112, and the bottom portion 110 of the snowboard stop device 100. In addition, the top portion 108 has a terminal top edge 128, and this terminal top edge 128 may be substantially perpendicular to each of the first and second side edges 124, 126 of the top portion 108 of the snowboard stop device 100. Similarly, the bottom portion 110 of the snowboard stop device 100 has a terminal bottom edge 130 that may be substantially perpendicular to each of the first and second side edges 124, 126 of the bottom portion 110 of the snowboard stop device 100. The corners joining the terminal top and bottom edges 128, 130 to the first and second side edges 124, 126 may be rounded, as show in the figures, sharp, or semi-sharp.

The bottom portion 110 of the snowboard stop device 100 has a snowboard-contactable side 132 that is adapted to at least partially contact the bottom side 116 of the snowboard 102 when the snowboard stop device 100 is clipped onto the snowboard 102. The bottom portion 110 of the snowboard stop device 100 may also have a ground-contactable side 134 that is adapted to at least partially contact the ground, including snow or ice, when the snowboard stop device 100 is clipped onto the snowboard 102 and the bottom side 116 of the snowboard 102 is in contact with the ground.

The ground-contactable side 134 of the bottom portion 110 of the snowboard stop device 100 may include, or be at least partially covered by, one or more protrusions or cleats 136 that are shaped, or otherwise adapted, to cause friction with the ground, including snow or ice, so as to stop or stabilize the snowboard 102 relative to the ground, thus allowing a snowboarder to take advantage of the stopped or stabilized position of the snowboard 102. The configuration, spacing, orientation, or shaping of the protrusions 136 are numerous. In the embodiment shown in FIGS. 3 through 7, the protrusions 136 are substantially equally spaced on the ground-contactable side or surface 134 of the bottom portion 110. This embodiment also sows that the protrusions 136 partially cover the curved, outer-facing side 138 of the curved edge portion 112. In an alternate embodiment, the protrusions 136 may extend, or be equally spaced over, more of the curved, outer-facing side 138 of the curved edge portion 112, including all or most of the curved outer-facing side 138 of the curved edge portion 112.

In the particular embodiments of FIGS. 3 through 7, the protrusions 136 include a first sub-set of protrusions 140 and a second sub-set of protrusions 142. The first sub-set of protrusions 140 has a different shape than the second sub-set of protrusions 142. In particular, the first sub-set of protrusions 140 has a substantially diamond shape with a substantially diamond-shaped indent or grooved centered therein. The second sub-set of protrusions 142 is generally smaller than the first sub-set of protrusions 140 and has an approximately polygonal shape. The first and second sub-sets of protrusions 140, 142 are generally uniformly interspersed and spread over the ground-contactable side 134 of the bottom portion 110 of the snowboard stop device 100.

It will be appreciated that the protrusions, or cleats, 136 may have many different shapes than that shown in FIGS. 3 through 7 which allow the protrusions 136 to cause friction with the ground. Also, the protrusions 136 are not limited to having two different shapes, as the protrusions 136 may all have a generally uniform shape, or may have three or more different sub-sets of shapes. The diamond or polygonal shapes shown in FIGS. 3 through 7 may also be varied to other types and shapes (e.g., square, circle, elliptical, rectangular, spherical or semicircular, beaded, ridged, triangular, etc.). The protrusions 136 may also be composed of any type of material that facilitates friction with the ground, including, but not limited to, hard or soft plastics or rubbers, metal, synthetic materials, etc. In an alternate embodiment, the ground-contactable side 134 of the bottom portion 110 may have no protrusions at all, and friction may be caused directly between the ground and the ground-contactable side 134 of the bottom portion 110 to cause the snowboard 102 to be stopped or stabilized.

The top portion 108 may be connected to the bottom portion 110 by the curved edge portion 112. The curved edge portion 112 may have an inner, snowboard-contactable surface 144 that may at least partially contact an edge of the snowboard 102 when the snowboard stop device 100 is clipped on the snowboard 102. In one embodiment, the inner, snowboard-contactable surface 144 may be formed from, or be covered by, a hard or rigid material that shields against damage to the snowboard stop device 100 resulting from any contact with the snowboard 102. For example, in the case of the snowboard 102 having a metal edge, the hard material forming or covering the inner, snowboard-contactable surface 144 may prevent the snowboard's metal edge from damaging the snowboard stop device 100. In one embodiment, the inner, snowboard-contactable surface 144 may be formed from a harder material than the snowboard-contactable side 132 of the bottom portion 110 and the snowboard-contactable side 146 of the top portion 108. In yet another embodiment, the inner, snowboard-contactable surface 144 of the curved edge portion 112 may be harder than the ground-contactable side 134 or the protrusions 136 of the bottom portion 110 of the snowboard stop device 100. Also, although the inner, snowboard-contactable surface 144 forms a substantially semicircular shape, the inner snowboard-contactable surface 144 may take on a variety of shapes or configurations (e.g., ridged, elliptical, pointed, etc.).

The top portion 108 of the snowboard stop device 100 may include the snowboard-contactable side 146 that is adapted to be in at least partial contact with the top side 114 of the snowboard 102 when the snowboard stop device 100 is clipped to the snowboard 102. The top portion 108 may include a terminal end portion 148 that tapers away from the bottom portion 110 of the snowboard stop device 100; the tapered terminal end portion 148 may ease the clipping of the snowboard stop device 100 onto the snowboard 102 by helping to guide the edge of the snowboard 102 into the space or cavity formed between the top and bottom portions 108, 110 of the snowboard stop device 100.

In one embodiment, the top portion 108 may include an aperture 150 therethrough. The aperture 150 may be used to receive a strap or string which may facilitate the storage, hanging, handling, or other purpose for the snowboard stop device 100. For example, a strap or string that is attached to the snowboard stop device 100 at the aperture 150 may be used to pull the snowboard stop device 100 off the edge of the snowboard 102, or may be used to hold, hang, or hook the snowboard stop device 100 on a part of the snowboarder's gear or apparel. In another example, a strap or string that is attached to the snowboard stop device 100 at the aperture 150 may be used to pull the snowboard stop device 100 from out of one of the snowboarder's pockets. In another example, the snowboard stop device 100 may be hung from a rack using the aperture 150, including for retail or other purposes. While the aperture 150 is shown to be located in the top portion 108 of the snowboard stop device 100, the aperture 150, in other embodiments, may be located anywhere on the snowboard stop device 100.

Figure 7:
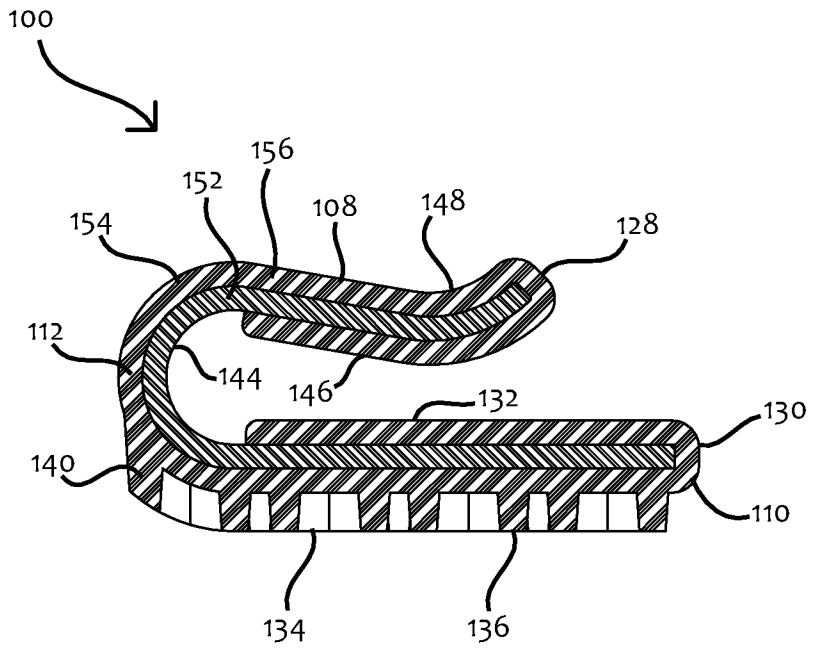
FIG. 7 is a schematic, cross-sectional view of the snowboard stop device in FIG. 6 taken along line 7-7.

In one embodiment, the snowboard stop device 100 may include a support plate 152 that extends through the top portion 108, the curved edge portion 112, and the bottom portion 110 of the snowboard stop device 100. The snowboard stop device 100 may also include a cover layer 154 that covers at least a portion of the support plate 152, and which may include the snowboard-contactable side 132 of the bottom portion 110, the ground-contactable side 134 of the bottom portion 110, and the snowboard-contactable side 146 of the top portion 108. The cover layer 154 may further include an outer-facing side 156 of the top portion 108 and the outer-facing side 138 of the curved edge portion 112. The cross-sectional view of FIG. 7 shows one embodiment of how the cover layer 154 may cover the support plate 152. The cover layer 154 may further include the protrusions 136 on the bottom portion 110 and/or the curved edge portion 112. Also, the cover layer 15 may include the first and second side edges 124, 126 of the snowboard stop device 100.

In one embodiment, the support plate 152 is formed from a harder material than the cover layer 154. Including a softer material as the snowboard-contactable sides 132, 146 of the top and bottom portions 108, 110 may help to prevent damage to the top and bottom sides 114, 116 of the snowboard 102. A softer material as the cover layer 154 may also facilitate friction between the ground and the ground-contactable side 134 of the bottom portion 110, including any protrusions 136 thereon.

In one embodiment the support plate 152 may be exposed at the inner, snowboard-contactable surface 144 of the curved edge portion 112. By exposing the support plate 152 in this manner, a harder material may be made to contact against an edge of the snowboard 102, as discussed above, to prevent damage to the snowboard stop device 100.

The cover layer 154 is shown in FIGS. 3 through 7 to be a substantially continuous piece of material partially covering the support plate 152. However, in other embodiments, this cover layer 154 may comprise two or more different layers or pieces located at different portions of the support plate 152, including any combination of those portions that are includable in the cover layer 154 mentioned above.

In use, a snowboarder may store the snowboard stop device 100 in his or her pocket or in any other location until the snowboarder desires to use the snowboard stop device 100. As mentioned above, handling of the snowboard stop device 100 may be facilitated by a strap, string or other material disposed through the aperture 150. When the snowboarder desires to stabilize or stop the snowboard 102 on the ground to prevent sliding, such as for the purpose of inserting or removing his or her boots into the bindings 104, 106, the snowboarder may clip the snowboard stop device 100 on any edge (e.g., the toe-side longitudinal edge 118) of the snowboard 102 such that the snowboard-contactable side 132 of the bottom portion 110 at least partially contacts the bottom side 116 of the snowboard 102 and the snowboard-contactable side 146 of the top portion 108 at least partially contacts the top side 114 of the snowboard 102.

After clipping the snowboard stop device 100 on an edge of the snowboard 102, the snowboarder may position the snowboard 102 and the snowboard stop device 100 relative to the ground to maximize friction between the ground and the protrusions 136 on the ground-contactable side 134 of the bottom portion 110. Such positioning may be accomplished by the snowboarder by pointing the snowboard stop device 100 in a suitable direction. Indeed, the snowboarder may periodically adjust the direction or orientation of the snowboard 102 and the snowboard stop device 100 to maximize friction with the ground. The positioning of the snowboard 102 and the snowboard stop device 100 may be dependent on the degree of slope, the direction of the slope, irregularities in a slope or on the ground, etc.

When the snowboard stop device 100 is clipped to the snowboard 102 and the ground-contactable side 134 of the bottom portion 110 contacts the ground, friction is caused between the ground and the protrusions 136 such that the snowboard at least partially stops or is stabilized relative to the ground. Once the snowboarder desires to once again move the snowboard 102 relative to the ground, the snowboarder may remove the snowboard stop device 100 from the edge of the snowboard 102 and store the snowboard stop device 100 as desired.

It will be appreciated that the snowboard stop device 100 may be used by snowboarders of all skill levels (e.g., beginner, intermediate, expert, etc.), and that snowboarders of any age or size (e.g., child, heavy adult, etc.) may use the snowboard stop device 100. Also, the snowboard stop device 100 may be used as described above on any snowboard style, shape, or thickness, and on snowboards having any camber or spatial dimensions.

As used herein, including in the claims, the terms first, second, third, etc. . . . used in relation to an element (e.g., first side, second side, etc.) are for reference or identification purposes only, and these terms, unless otherwise indicated, are not intended to describe or suggest a number, order, source, purpose, or substantive quality for any element for which such a term is used.

Although the illustrative embodiments described herein have been disclosed in the context of certain illustrative, non-limiting embodiments, it should be understood that various changes, substitutions, permutations, and alterations can be made without departing from the scope of the invention as defined by the appended claims. It will be appreciated that any feature that is described in a connection to any one embodiment may also be applicable to any other embodiment.

What is claimed is:

1. A snowboard stop device comprising:

a bottom portion having a snowboard-contactable side and a ground-contactable side, the ground-contactable side of the bottom portion having one or more protrusions;

a top portion having a snowboard-contactable side; and a curved edge portion joining the bottom portion of the snowboard stop device to the top portion of the snowboard stop device;

wherein the snowboard stop device is clippable on an edge of a snowboard such that the snowboard-contactable side of the bottom portion at least partially contacts a bottom side of the snowboard and the snowboard-contactable side of the top portion at least partially contacts a top side of the snowboard;

wherein, when the snowboard stop device is clipped to the snowboard, friction is caused between the ground and the one or more protrusions on the ground-contactable side of the bottom portion such that the snowboard at least partially stops relative to the ground;

wherein the snowboard comprises a left-foot binding and a right-foot binding; and wherein the snowboard stop device is adapted to be clipped on a toe-side longitudinal edge of the snowboard at a position substantially between the left-foot binding and the right-foot binding of the snowboard.

2. The snowboard stop device of claim 1, wherein, when the snowboard stop device is clipped on the edge of the snowboard, the top portion of the snowboard stop device is biased against the top side of the snowboard and the bottom portion of the snowboard stop device is biased against the bottom side of the snowboard to substantially anchor the snowboard stop device at the edge of the snowboard at which the snowboard stop device is clipped.

3. The snowboard stop device of claim 1, wherein the one or more protrusions is a plurality of protrusions; and wherein the plurality of protrusions comprises a plurality of substantially diamond-shaped protrusions.

4. The snowboard stop device of claim 1, wherein the one or more protrusions is a plurality of protrusions; and wherein the plurality of protrusions comprises a first sub-set of protrusions and a second sub-set of protrusions, the first sub-set of protrusions having a different shape than the second sub-set of protrusions.

5. The snowboard stop device of claim 4, wherein the first sub-set of protrusions has a substantially diamond shape.

6. The snowboard stop device of claim 1, wherein the top portion of the snowboard stop device has a terminal end portion, the terminal end portion tapering away from the bottom portion of the snowboard stop device.

7. The snowboard stop device of claim 1, wherein the snowboard stop device further comprises:

a first side edge of the bottom portion, the curved edge portion, and the top portion of the snowboard stop device; and a second side edge of the bottom portion, the curved edge portion, and the top portion of the snowboard stop device;

wherein the top portion of the snowboard stop device comprises a terminal top edge substantially perpendicular to each of the first side edge and the second side edge of the top portion of the snowboard stop device; and wherein the bottom portion of the snowboard stop device comprises a terminal bottom edge substantially perpendicular to each of the first side edge and the second side edge of the bottom portion of the snowboard stop device.

8. A snowboard stop device comprising:

a bottom portion having a snowboard-contactable side and a ground-contactable side, the ground-contactable side of the bottom portion having one or more protrusions;

a top portion having a snowboard-contactable side; and a curved edge portion joining the bottom portion of the snowboard stop device to the top portion of the snowboard stop device;

wherein the snowboard stop device is clippable on an edge of a snowboard such that the snowboard-contactable side of the bottom portion at least partially contacts a bottom side of the snowboard and the snowboard-contactable side of the top portion at least partially contacts a top side of the snowboard;

wherein, when the snowboard stop device is clipped to the snowboard, friction is caused between the ground and the one or more protrusions on the ground-contactable side of the bottom portion such that the snowboard at least partially stops relative to the ground;

wherein the curved edge portion has a curved, outer-facing side; and wherein the ground-contactable side of the bottom portion and the curved, outer-facing side of the curved edge portion comprises the one or more protrusions.

9. The snowboard stop device of claim 8, wherein, when the snowboard stop device is clipped on the edge of the snowboard, the top portion of the snowboard stop device is biased against the top side of the snowboard and the bottom portion of the snowboard stop device is biased against the bottom side of the snowboard to substantially anchor the snowboard stop device at the edge of the snowboard at which the snowboard stop device is clipped.

10. A snowboard stop device comprising:

a bottom portion having a snowboard-contactable side and a ground-contactable side, the ground-contactable side of the bottom portion having one or more protrusions;

a top portion having a snowboard-contactable side; and a curved edge portion joining the bottom portion of the snowboard stop device to the top portion of the snowboard stop device;

wherein the snowboard stop device is clippable on an edge of a snowboard such that the snowboard-contactable side of the bottom portion at least partially contacts a bottom side of the snowboard and the snowboard-contactable side of the top portion at least partially contacts a top side of the snowboard;

wherein, when the snowboard stop device is clipped to the snowboard, friction is caused between the ground and the one or more protrusions on the ground-contactable side of the bottom portion such that the snowboard at least partially stops relative to the ground; and wherein the curved edge portion has an inner, snowboard-contactable surface comprised of a harder material than each of the snowboard-contactable side of the bottom portion and the snowboard-contactable side of the top portion, the harder material adapted to resist damage to the snowboard stop device from the snowboard.

11. The snowboard stop device of claim 10, wherein the inner, snowboard-contactable surface of the curved edge portion has a substantially semi-circular shape.

12. The snowboard stop device of claim 10, wherein, when the snowboard stop device is clipped on the edge of the snowboard, the top portion of the snowboard stop device is biased against the top side of the snowboard and the bottom portion of the snowboard stop device is biased against the bottom side of the snowboard to substantially anchor the snowboard stop device at the edge of the snowboard at which the snowboard stop device is clipped.

13. The snowboard stop device of claim 10, wherein the one or more protrusions is a plurality of protrusions; and wherein the plurality of protrusions comprises a plurality of substantially diamond-shaped protrusions.

14. The snowboard stop device of claim 10, wherein the one or more protrusions is a plurality of protrusions; and wherein the plurality of protrusions comprises a first sub-set of protrusions and a second sub-set of protrusions, the first sub-set of protrusions having a different shape than the second sub-set of protrusions.

15. The snowboard stop device of claim 14, wherein the first sub-set of protrusions has a substantially diamond shape.

16. The snowboard stop device of claim 10, wherein the top portion of the snowboard stop device has a terminal end portion, the terminal end portion tapering away from the bottom portion of the snowboard stop device.

17. The snowboard stop device of claim 10, wherein the snowboard stop device further comprises:

a first side edge of the bottom portion, the curved edge portion, and the top portion of the snowboard stop device; and a second side edge of the bottom portion, the curved edge portion, and the top portion of the snowboard stop device;

wherein the top portion of the snowboard stop device comprises a terminal top edge substantially perpendicular to each of the first side edge and the second side edge of the top portion of the snowboard stop device; and wherein the bottom portion of the snowboard stop device comprises a terminal bottom edge substantially perpendicular to each of the first side edge and the second side edge of the bottom portion of the snowboard stop device.

18. A snowboard stop device comprising:

a bottom portion having a snowboard-contactable side and a ground-contactable side, the ground-contactable side of the bottom portion having one or more protrusions;

a top portion having a snowboard-contactable side; and a curved edge portion joining the bottom portion of the snowboard stop device to the top portion of the snowboard stop device;

wherein the snowboard stop device is clippable on an edge of a snowboard such that the snowboard-contactable side of the bottom portion at least partially contacts a bottom side of the snowboard and the snowboard-contactable side of the top portion at least partially contacts a top side of the snowboard;

wherein, when the snowboard stop device is clipped to the snowboard, friction is caused between the ground and the one or more protrusions on the ground-contactable side of the bottom portion such that the snowboard at least partially stops relative to the ground;

wherein the snowboard stop device further comprises a support plate extending through the top portion, the curved edge portion, and the bottom portion of the snowboard stop device;

wherein the snowboard stop device further comprises a cover layer covering at least a portion of the support plate, the cover layer comprising the snowboard-contactable side of the bottom portion, the ground-contactable side of the bottom portion, and the snowboard-contactable side of the top portion; and wherein the support plate is formed from a harder material than the cover layer.

19. The snowboard stop device of claim 18, wherein the top portion of the snowboard stop device has an outer-facing side;

wherein the curved edge portion of the snowboard stop device has an outer-facing side; and wherein the cover layer further comprises the outer-facing side of the top portion of the snowboard stop device and the outer-facing side of the curved edge portion of the snowboard stop device.

20. The snowboard stop device of claim 18, wherein the curved edge portion has an inner, snowboard-contactable surface comprised of an exposed portion of the support plate.

* * * * *